US009217431B2

(12) United States Patent
Schulz-Andres et al.

(10) Patent No.: US 9,217,431 B2
(45) Date of Patent: Dec. 22, 2015

(54) VANE PUMP

(75) Inventors: Heiko Schulz-Andres, Hueckeswagen (DE); Christian Böhm, Frankfurt am Main (DE)

(73) Assignee: ixetic Bad Homburg GmbH, Bad Homburg (DE)

( * ) Notice: Subject to any disclaimer, the term of this patent is extended or adjusted under 35 U.S.C. 154(b) by 785 days.

(21) Appl. No.: 13/500,621

(22) PCT Filed: Sep. 9, 2010

(86) PCT No.: PCT/EP2010/005540

§ 371 (c)(1), (2), (4) Date: Jul. 11, 2012

(87) PCT Pub. No.: WO2011/042105

PCT Pub. Date: Apr. 14, 2011

(65) Prior Publication Data

US 2012/0275945 A1 Nov. 1, 2012

(30) Foreign Application Priority Data

Oct. 7, 2009 (DE) ..... 10 2009 049 532

(51) Int. Cl.

| | |
|---|---|
| ***F04C 2/344*** | (2006.01) |
| ***F01C 21/08*** | (2006.01) |
| ***F04C 11/00*** | (2006.01) |
| ***F04C 15/06*** | (2006.01) |

(52) U.S. Cl.

CPC ..... *F04C 2/344* (2013.01); *F01C 21/0863* (2013.01); *F04C 11/001* (2013.01); *F04C 15/06* (2013.01); *F04C 2240/30* (2013.01); *F04C 2240/80* (2013.01)

(58) Field of Classification Search

CPC .. F04C 15/06; F04C 2240/30; F04C 2240/80; F04C 11/001; F04C 2/344; F04C 2/3446; F04C 15/0003; F04C 15/003; F04C 27/00; F04C 27/007; F01C 21/0863; F01C 21/0809

USPC ..... 417/410.3; 418/266–268, 259, 24–26, 418/82

See application file for complete search history.

(56) References Cited

U.S. PATENT DOCUMENTS

| | | | | |
|---|---|---|---|---|
| 2,993,445 | A | 7/1961 | Ostwald | |
| 4,403,929 | A * | 9/1983 | Nagasaku et al. | 418/82 |
| 4,633,767 | A | 1/1987 | Sain | |
| 4,971,535 | A * | 11/1990 | Okada et al. | 418/133 |
| 5,692,761 | A | 12/1997 | Havlovitz | |

FOREIGN PATENT DOCUMENTS

| | | |
|---|---|---|
| DE | 39 13 414 | 10/1990 |
| DE | 195 14 929 | 11/1995 |
| DE | 196 31 846 | 2/1997 |
| GB | 1 498 710 | 1/1978 |
| JP | 3-118286 | 12/1991 |
| WO | WO 03/056180 | 7/2003 |
| WO | WO 2007/039732 | 4/2007 |

* cited by examiner

*Primary Examiner* — Bryan Lettman
(74) *Attorney, Agent, or Firm* — Cozen O'Connor

(57) ABSTRACT

A vane cell pump having an over vane pump associated with a first consumer and an under vane pump including an under vane pressure area and an under vane suction area which is connected to the over vane pump. The under vane pressure area is separated from the under vane suction area and is associated with a second consumer.

16 Claims, 9 Drawing Sheets

VANE PUMP

CROSS REFERENCE TO RELATED APPLICATIONS

This is a U.S. national stage of application No. PCT/EP2010/005540, filed on 9 Sep. 2010. Priority is claimed on German Application No. 10 2009 049 532.0, filed 7 Oct. 2009, the content of which is incorporated here by reference.

BACKGROUND OF THE INVENTION

1. Field of the Invention

The invention is directed to a vane cell pump having an over vane pump associated with a first consumer and an under vane pump comprising an under vane pressure area and an under vane suction area connected to the over vane pump.

A generic vane cell pump with at least two pump portions having, respectively, a suction area and a pressure area is known from German Laid-Open Application DE 196 31 846 A1. A vehicle device known from German Laid-Open Application DE 195 14 929 A1 has a drive motor having at least two auxiliary units associated therewith, which are drivable by an individual electric motor.

SUMMARY OF THE INVENTION

In a vane cell pump having an over vane pump associated with a first consumer and an under vane pump comprising an under vane pressure area and an under vane suction area connected to the over vane pump, an object of the invention is to modify this vane cell pump such that different consumers can be supplied by the vane cell pump with hydraulic medium volume flows of different magnitudes and/or different pressures.

In one embodiment of a vane cell pump having an over vane pump associated with a first consumer and an under vane pump comprising an under vane pressure area and an under vane suction area connected to the over vane pump, the under vane pressure area is separated from the under vane suction area and is associated with a second consumer. According to an important aspect of the invention, the under vane pressure area is associated with the second consumer. As a result of the subdivision of the under vane pump carried out according to one embodiment of the invention, different volume flows at different pressure levels can be supplied simultaneously by the vane cell pump in a simple manner.

A preferred embodiment of the vane cell pump is characterized in that the under vane suction area and the under vane pressure area can be acted upon by different pressures. This makes it possible for the vane cell pump to supply different pressure levels simultaneously for different consumers. The under vane suction area and the under vane pressure area are also referred to as under vane areas.

Another preferred embodiment of the vane cell pump is characterized in that the under vane suction area comprises at least one under vane slot portion which is associated with the first consumer via a pressure area of the over vane pump. In the pressure area of the over vane pump, a hydraulic medium is acted upon by pressure and is conveyed to the first consumer in the form of a hydraulic medium volume flow. By a connection between the under vane slot portion of the under vane suction area and the pressure area of the over vane pump, this under vane slot portion is brought to the same pressure level as the first consumer.

Another preferred embodiment of the vane cell pump is characterized in that the under vane slot portion of the under vane suction area is arranged radially inwardly and overlapping in circumferential direction in relation to a suction area of the over vane pump. By this arrangement and the connection to the pressure area of the over vane pump, it is ensured that the vanes of the vane cell pump move out reliably so as to radially outwardly contact a lift contour of the vane cell pump.

Another preferred embodiment of the vane cell pump is characterized in that the under vane pressure area comprises at least one under vane slot portion associated with the second consumer. The under vane slot portion of the under vane pressure area preferably directly communicates with the second consumer, for example, by a corresponding hydraulic line or a corresponding hydraulic channel. The under vane pressure area is supplied with hydraulic medium during operation of the vane cell pump by entraining the hydraulic medium from the under vane suction area.

Another preferred embodiment of the vane cell pump is characterized in that the under vane slot portion of the under vane pressure area is arranged radially inwardly and overlapping in circumferential direction in relation to a pressure area, or the pressure area, of the over vane pump. In the pressure area of the over vane pump, the vanes move radially inward during operation of the vane cell pump so that the hydraulic medium in the under vane slot portion of the under vane pressure area is pressurized by the inwardly moving vanes. The inward movement of the vanes in the pressure area is caused by the lift contour of the vane cell pump.

Another preferred embodiment of the vane cell pump is characterized in that the under vane suction area and the under vane pressure area each comprise two diametrically arranged under vane slot portions. The under vane slot portions of the under vane suction area are preferably each arranged radially inwardly and overlapping in circumferential direction in relation to, respectively, one of two suction areas of the vane cell pump. Similarly, the under vane slot portions of the under vane pressure area are preferably each arranged radially inwardly and overlapping in circumferential direction in relation to, respectively, one of two pressure areas of the vane cell pump.

Another preferred embodiment of the vane cell pump is characterized in that the under vane suction area and the under vane pressure area are separated from one another by a seal. The seal prevents an unintentional pressure equalization between the two under vane areas.

Another preferred embodiment of the vane cell pump is characterized in that the seal viewed from above essentially has the shape of a figure 8, the under vane suction area being arranged outside of the figure 8 and the under vane pressure area being arranged inside the figure 8. In contrast to the way in which a figure 8 is usually written, the figure 8 is so shaped in the middle that there remains an open gap providing a connection between the two under vane slot portions of the under vane pressure area.

Another preferred embodiment of the vane cell pump is characterized in that the second consumer comprises a hydraulic accumulator. The hydraulic accumulator preferably serves to store hydraulic medium which is needed, for example, in a transmission of a motor vehicle for shifting processes. The required hydraulic pressure is about 20 bar, for example. In contrast, the first consumer needs an appreciably lower pressure, e.g., 3 bar.

Another preferred embodiment of the vane cell pump is characterized in that a non-return valve is arranged between the second consumer and the under vane pressure area associated therewith. The non-return valve prevents unwanted backflow of hydraulic medium. Further, the non-return valve makes it possible to switch off the under vane pressure area associated with the second consumer as needed.

Another preferred embodiment of the vane cell pump is characterized in that the under vane pressure area can be connected to the under vane suction area by a switching valve device. The switching valve device serves to switch off the under vane pressure area. In this way, the power needed to drive the vane cell pump can be reduced. The under vane pressure area can be switched on as needed by the switching valve device for continuous charging of the hydraulic accumulator.

Another preferred embodiment of the vane cell pump is characterized in that the under vane pressure area can be connected to the first consumer by a switching valve device. This embodiment is particularly advantageous when the vane cell pump is driven electrically and has a higher starting speed than pumps driven directly by a combustion engine.

Another preferred embodiment of the vane cell pump is characterized in that the switching valve device can be actuated electromagnetically or hydraulically. By electromagnetic actuation of the switching valve device the under vane pressure area can be connected to the under vane suction area or to the first consumer whenever the pressure in the hydraulic accumulator lies above a desired minimum pressure. In so doing, the pressure in the hydraulic accumulator is acquired by a pressure sensor. When the switching valve device is actuated hydraulically, the pressure in the hydraulic accumulator can be used directly for sensing.

Another preferred embodiment of the vane cell pump is characterized in that an additional valve device is connected between the under vane suction area or the pressure area of the over vane pump and the consumer associated therewith. The valve device can be constructed as a switching valve or as a non-return valve. The additional valve device preferably serves to separate the pressure output of the over vane pump from the first consumer when the vane cell pump is stopped.

Another preferred embodiment of the vane cell pump is characterized in that the operating pressure is greater in the under vane pressure area than in the under vane suction area. This ensures that the vanes in the pressure area and in a dividing region of the over vane pump always contact the lift contour.

Another preferred embodiment of the vane cell pump is characterized in that a hydraulic resistance is connected between the under vane areas or between the under vane area and the first consumer. The hydraulic resistance is formed, for example, as a hydraulic bottleneck or as a throttle.

BRIEF DESCRIPTION OF THE DRAWINGS

Other advantages, features and details of the invention are indicated in the following description in which various embodiment examples are described in detail with reference to the drawings. In the drawings.

DETAILED DESCRIPTION OF THE PREFERRED EMBODIMENTS

Figure 1:
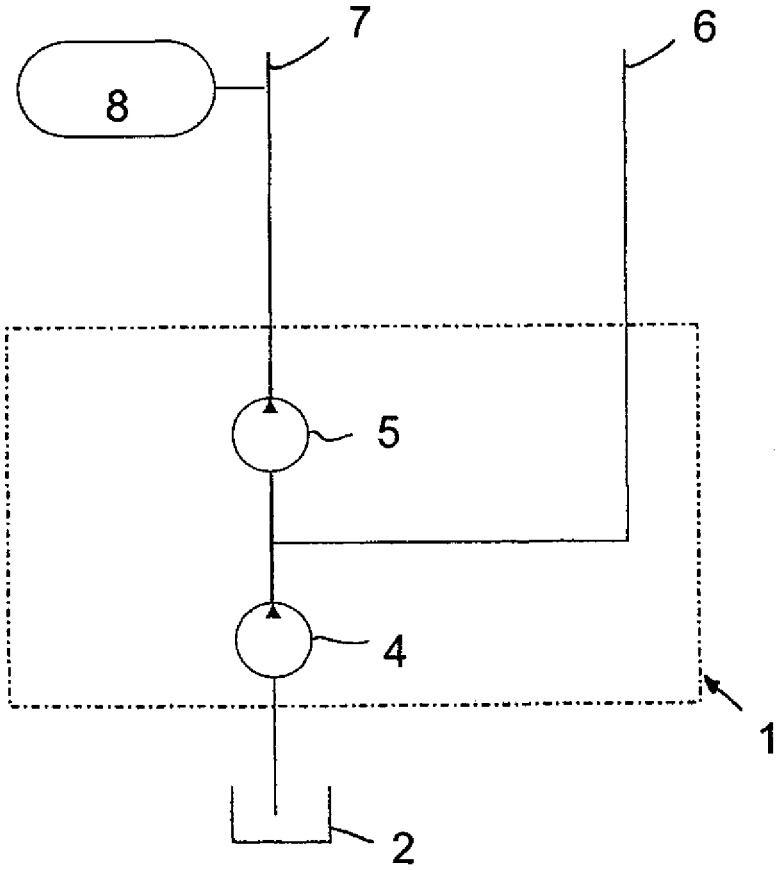
FIG. 1 is a highly simplified diagram of a vane cell pump according to one embodiment of the invention.
Figure 2:
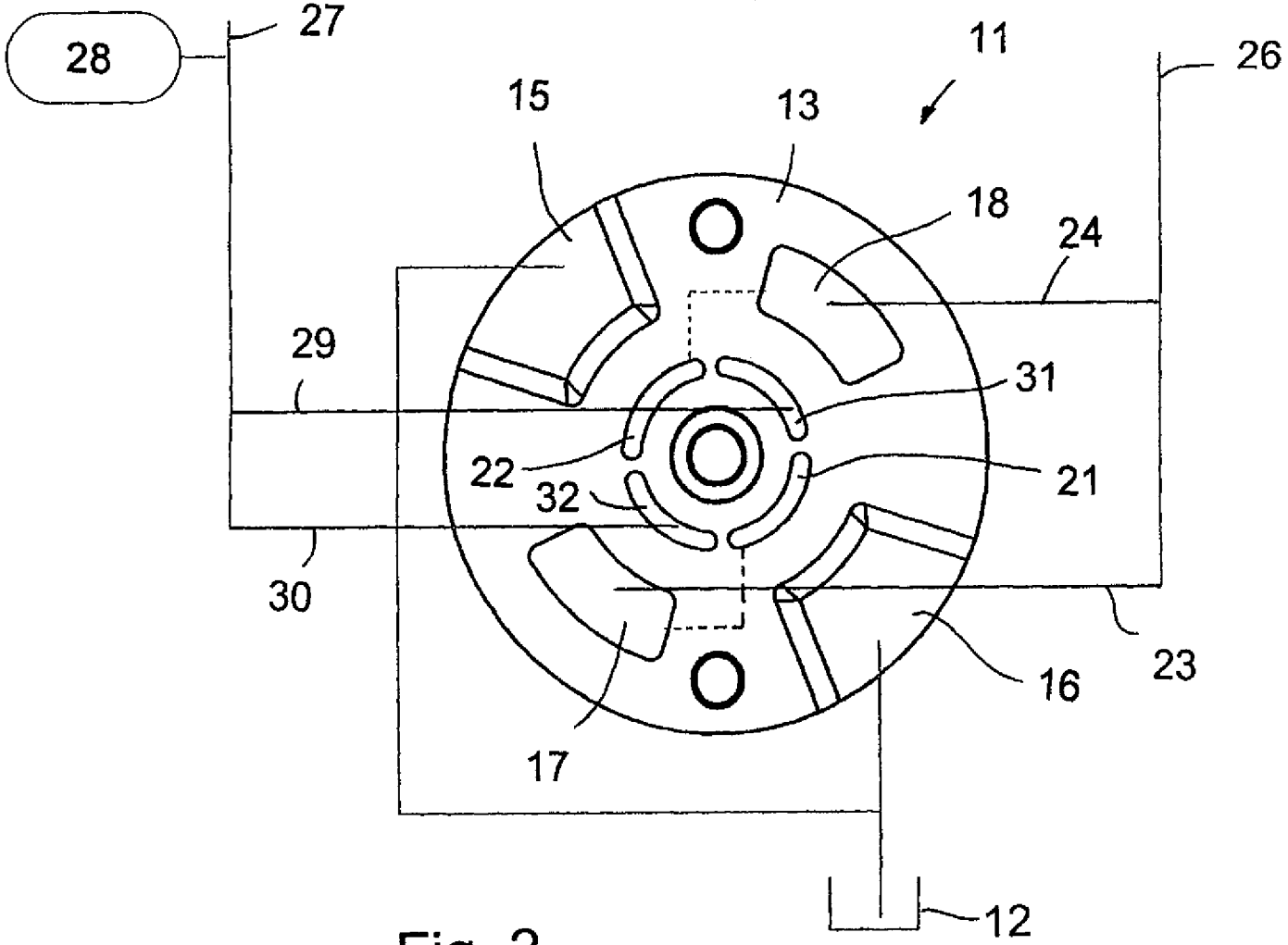
FIG. 2 is an example of the vane cell pump having two different consumers with different hydraulic medium volume flows which have different pressures.

A vane cell pump 1 is shown schematically in FIG. 1 in a highly simplified manner. The construction and operation of the vane cell pump 1 are described, for example, in German Laid-Open Application DE 196 31 846 A1.

Switchable double-stroke vane cell pumps can be used to meet the hydraulic demand of two different volume flows at different pressure levels at the same time in a hydraulic transmission control. In so doing, the two pump flows yielded by the double-stroke design are conveyed out of the pump separately from one another and supplied to different consumers.

It is also possible to use two or more separate pumps to supply different consumers with different volume flows and/or pressures. In German Laid-Open Application DE 195 14 929 A1, it is proposed to drive two pumps by an individual electric motor.

Hydraulic medium is supplied from a tank 2 to an over vane pump area 4 and an under vane pump area 5 by the vane cell pump 1 which is shown in a highly simplified manner in FIG. 1. The two vane pump areas 4, 5 make up a vane pump driven by the vanes of the vane cell pump 1. The pumping action of the under vane pump is achieved by a lifting movement of the radially inner ends of the vanes.

The vane cell pump 1 comprises the over vane pump having two substantially sickle-shaped pump chambers through which the vanes run and which are arranged in radial direction between a rotor and a lift contour. The rotor and the lift contour are defined in axial direction on one side by a pressure plate which is arranged in a housing of the vane cell pump 1.

The over vane pump area 4 communicates with a first consumer 6. The under vane pump area 5 communicates with a second consumer 7. The second consumer 7 comprises a hydraulic accumulator 8. The vane cell pump 1 is used, preferably in a motor vehicle, for supplying a transmission with hydraulic medium which is pressurized with different pressures by the vane cell pump 1. The hydraulic accumulator 8, for example, needs a hydraulic pressure of about 20 bar. The under vane pump area 5 has a displacement volume of about one cubic centimeter. The vane cell pump 1 is preferably driven by an electric motor.

The first consumer 6 is a wet clutch, for example, which needs a volume flow of up to 30 liters per minute at a pressure of 3 bar for cooling. Using the over vane pump 4 and under vane pump of the vane cell pump 1, a volumetric flow ratio of 7 to 1 and a pressure ratio of 1 to 6 can be provided. In so doing, the two vane pump areas 4 and 5 can be operated simultaneously. Moreover, it is possible to switch off the under vane pump area 5 to keep the torque requirement needed for driving as low as possible at low temperatures. According to an important aspect of the invention, the under vane pump of the vane cell pump 1 is used with its under vane pump area 5 as independent pump for charging the hydraulic accumulator 8.

FIGS. 2 to 8 and 10 to 11 show a vane cell pump 11 in various embodiment examples. Identical or similar parts are provided with the same reference numbers. The vane cell pump 1 is connected to a tank 12 with hydraulic medium, particularly oil. For a better understanding of the invention, mainly a pressure plate 13 of the vane cell pump 1 is shown; this pressure plate 13 forms an axial contact surface for the rotor and/or the vanes of the vane cell pump 1.

The pressure plate 13 comprises two suction areas 15, 16 and two pressure areas 17, 18 of the over vane pump. The pressure plate 13 further comprises an under vane pump with an under vane suction area which comprises two under vane slot portions 21, 22. The two under vane slot portions 21, 22 are arranged radially inwardly and overlapping in circumferential direction in relation to the two suction areas 15, 16 of the over vane pump. Hydraulic lines or hydraulic channels which connect the two under vane slot portions 21, 22 to one of the pressure areas 17, 18, respectively, of the over vane pump are indicated by dashed lines. The pressure areas 17, 18 of the over vane pump in turn communicate with a first consumer 26 via hydraulic lines or hydraulic channels 23, 24.

A second consumer 27 comprises a hydraulic accumulator 28 and communicates via hydraulic lines or hydraulic channels 29, 30 with under vane slot portions 31, 32 of an under vane pressure area of the under vane pump. The two under vane slot portions 31, 32 are each arranged radially inwardly and overlapping in circumferential direction in relation to the pressure areas 18, 17 of the over vane pump. The under vane slot portions 21, 22 and 31, 32 are shaped substantially as circular arcs arranged on a common circle.

The under vane slot portions 21, 22 of the under vane suction area are filled with hydraulic medium from the under vane pump, for example, via channels or bore holes, indicated by dashed lines, in the pressure plate 13. During operation of the vane cell pump 1, the vanes are forcibly moved out into the suction areas 15, 16 by the pressure in the two under vane slot portions 21, 22. By design, the vanes are moved into the under vane slot portions 31, 32 through cooperation with the lift contour so that the hydraulic medium in the under vane slot portions 31, 32 is pressurized by the inward-moving vanes. This relatively high pressure is used to fill the hydraulic accumulator 28 with hydraulic medium. The relatively small volume flow resulting from the small size of the under vane slot portions 31, 32 is sufficient for this purpose. By the pressure areas 17, 18 of the over vane pump, the first consumer 26 is supplied with an appreciably greater volume flow which, however, is acted upon by an appreciably lower pressure.

Figure 4:
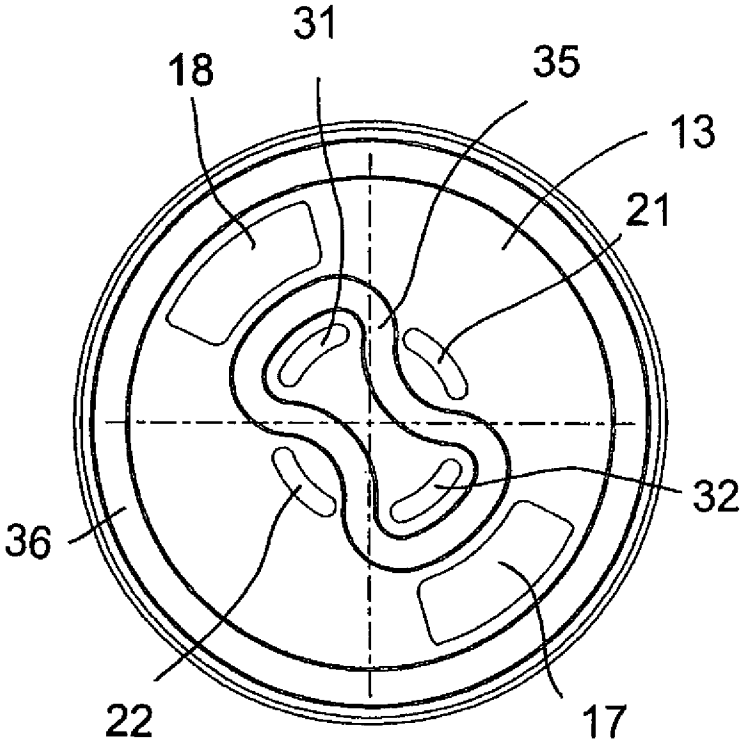
FIG. 4 is a bottom view of the pressure plate from FIG. 3.
Figure 3:
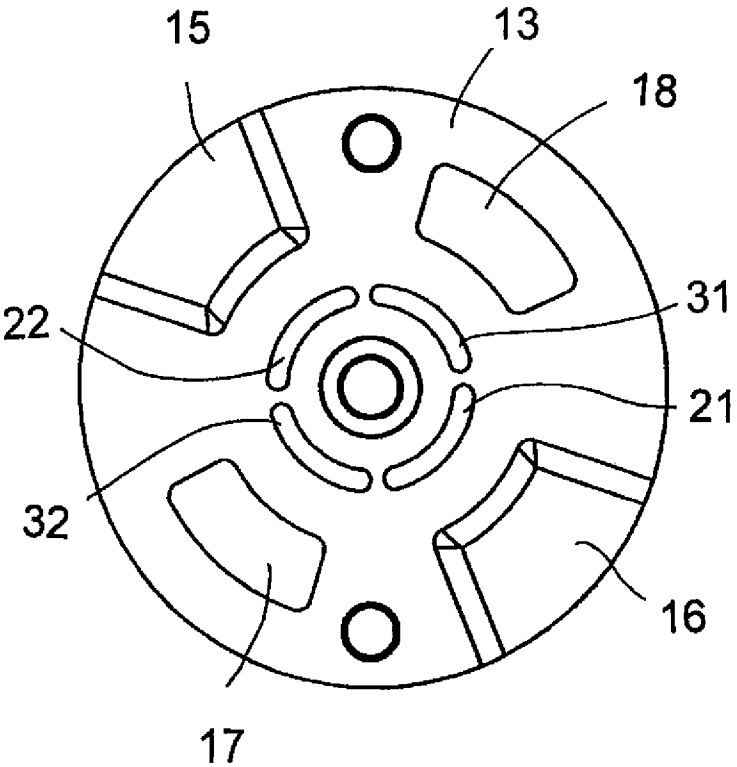
FIG. 3 is a top view of a pressure plate of the vane cell pump from FIG. 2.

In FIGS. 3 and 4, the pressure plate 13 is shown in a top view on one side and flipped 180° in a bottom view on the other side. The separations between the under vane slot portions 21, 22 and 31, 32 are preferably located in angular areas of the lift contour at which no substantial change in volume of the pumping chambers or the vane cell pump 11 occurs.

Figure 8:
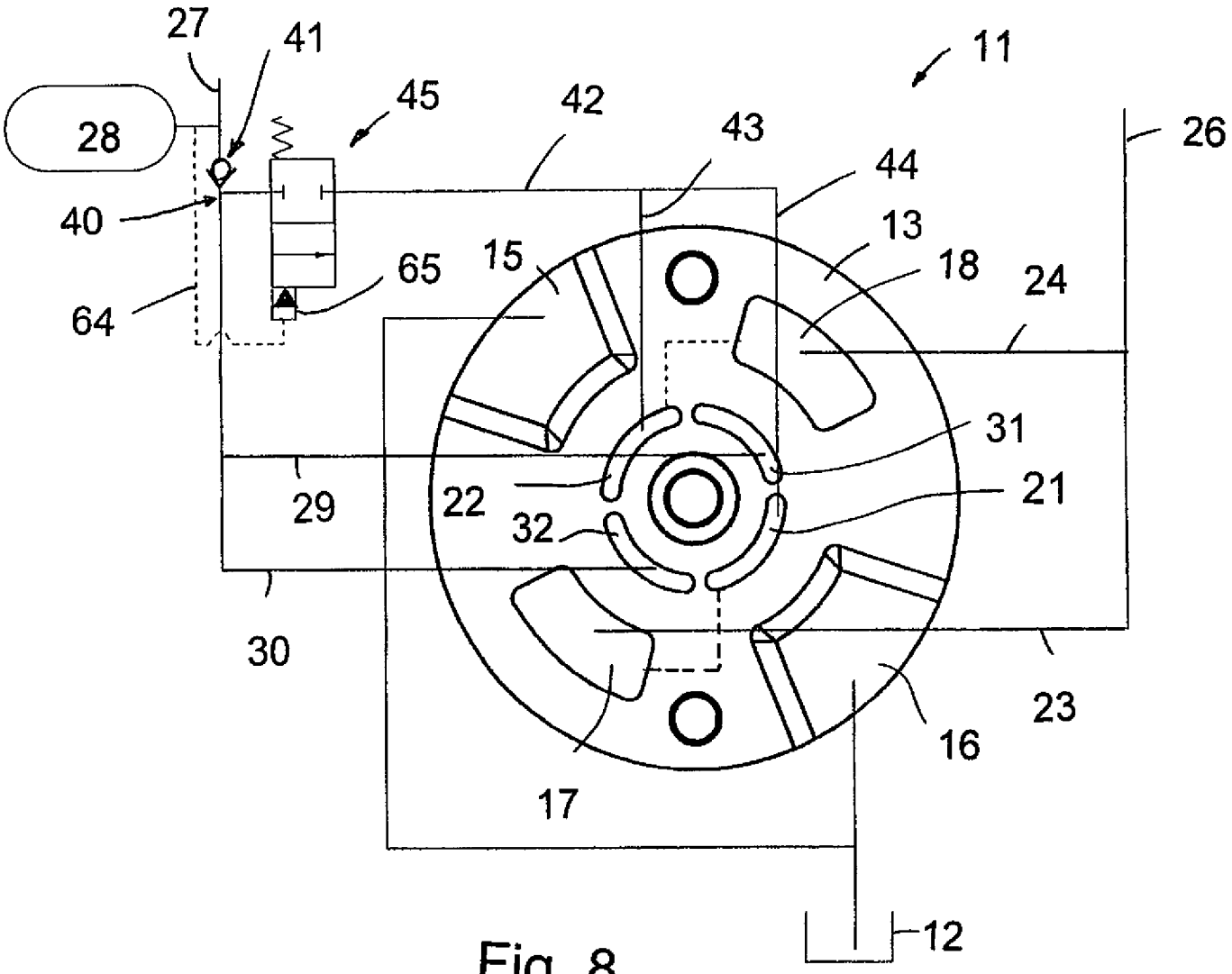
FIG. 8 is an example similar to that in FIG. 5 with a different switching valve.

It will be seen in FIG. 4 that the two under vane slot portions 31, 32 are arranged inside a substantially figure 8-shaped first seal 35. The two under vane slot portions 21, 22 and the pressure areas 17, 18 of the over vane pump which extend through the pressure plate 13 are arranged outside the figure 8-shaped first seal 35 and inside a circular second seal 36. The two seals 35, 36 serve to seal against a housing of the vane cell pump 11 or a control plate of a transmission.

In the illustrated embodiment example, the figure 8-shaped first seal 35 is constructed in such a way that the two under vane slot portions 31, 32 communicate with one another. However, by altering the first seal 35 in a corresponding manner or by using two circular seals, the two under vane slot portions 31, 32 can also be sealed individually. The pressure transfer illustrated in FIG. 4 has the advantage that an unwanted bending deflection of the plate due to the increased pressure in the under vane slot portions 31, 32 on the rotor side of the pressure plate 13 can be compensated by the application of increased pressure on the sealing side relative to the housing or a control plate of a transmission.

Additional compensation can be achieved through the configuration, according to one embodiment of the invention, of the pressure-loaded surface and the thickness of the pressure plate 13. In so doing, the gap heights should always be designed in a dimension corresponding in inverse proportion to the pressure. Drag can be minimized in this way. Because of the arrangement, according to the invention, of the two seals 35, 36, it is possible to integrate the vane cell pump 11 without housing as a plug-in component in a control plate of a transmission.

Through suitable selection of the vane geometry, the ratio of the volume flows supplied to the two consumers 26, 27 can be varied. The pump volume of the under vane pump is given by the thickness of the vanes and the length of the vane lift By varying the vane thickness, the displacement volume of the under vane pump can be varied in a simple manner. With a given geometry of the over vane pump, doubling the vane thickness leads to an appreciable alteration in the pump delivery volume. The input power of the vane cell pump can likewise be influenced by a suitable selection of the ratio of the width of the rotor assembly to the vane lift.

Figure 5:
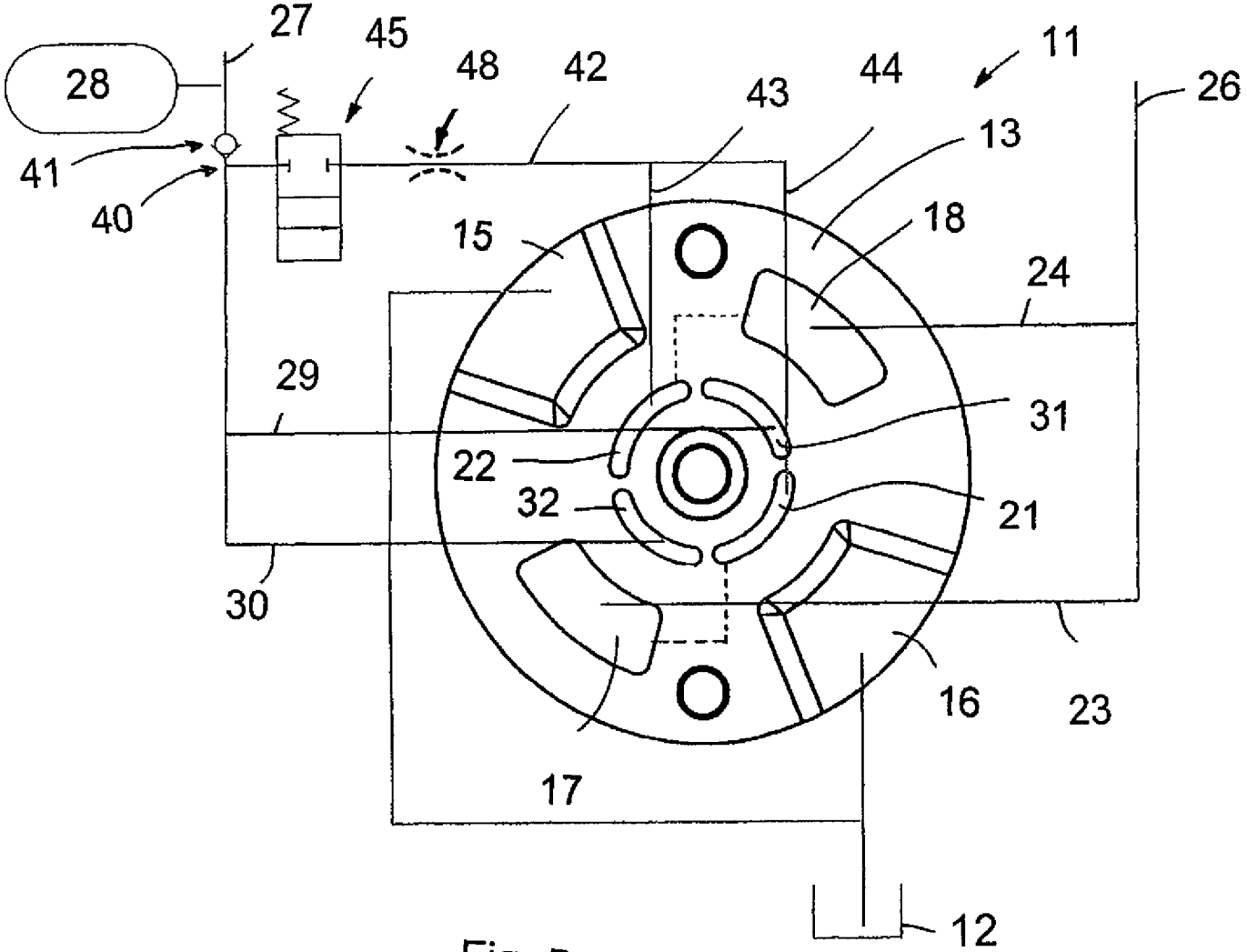
FIG. 5 is an example similar to that in FIG. 2 with a connection between different under vane areas.

In the embodiment shown in FIG. 5, a branch 40 is provided between the hydraulic lines 29, 30 and the second consumer 27. A non-return valve 41 provided between the branch 40 and the second consumer 27 prevents unwanted backflow of hydraulic medium from the hydraulic accumulator 28 when the vane cell pump 11 is stopped. Further, the non-return valve 41 makes it possible to switch off the under vane pump, particularly the under vane pump area with the under vane slot portions 31, 32 which is associated with the second consumer 27. This is especially helpful when the vane cell pump 11 is applied according to one embodiment of the invention because the charging of the hydraulic accumulator 28 is preferably carried out intermittently.

A hydraulic line or a hydraulic channel 42 leads from the branch 40 and is connected by additional hydraulic lines or hydraulic channels 43, 44 to the two under vane slot portions 21, 22 of the under vane suction area. A switching valve device 45 which is constructed as a 2/2 directional control valve with an open position and a blocking position is arranged in the hydraulic line 42. The switching valve device 45 is pre-loaded in the illustrated blocking position by a spring.

In the blocking position, the connection between the under vane slot portions 31, 32 of the second under vane pump area and the under vane slot portions 21, 22 of the under vane suction area is interrupted so that the hydraulic accumulator 8 is charged via the two under vane slot portions 31, 32 of the under vane pressure area.

By switching the switching valve device 45 into the open position, the connection between the under vane slot portions 31, 32 of the under vane pressure area with the under vane slot portions 21, 22 of the under vane suction area is released. The driving output of the vane cell pump 1 can be reduced when there is no need to charge the hydraulic accumulator 28. Further, the connection of the two under vane pump areas by the switching valve 45 offers the advantage that hydraulic medium is immediately conveyed under the vanes into the suction areas 15, 16 when starting the vane cell pump 1 so as to force these vanes to move out.

Figures 6, 7:
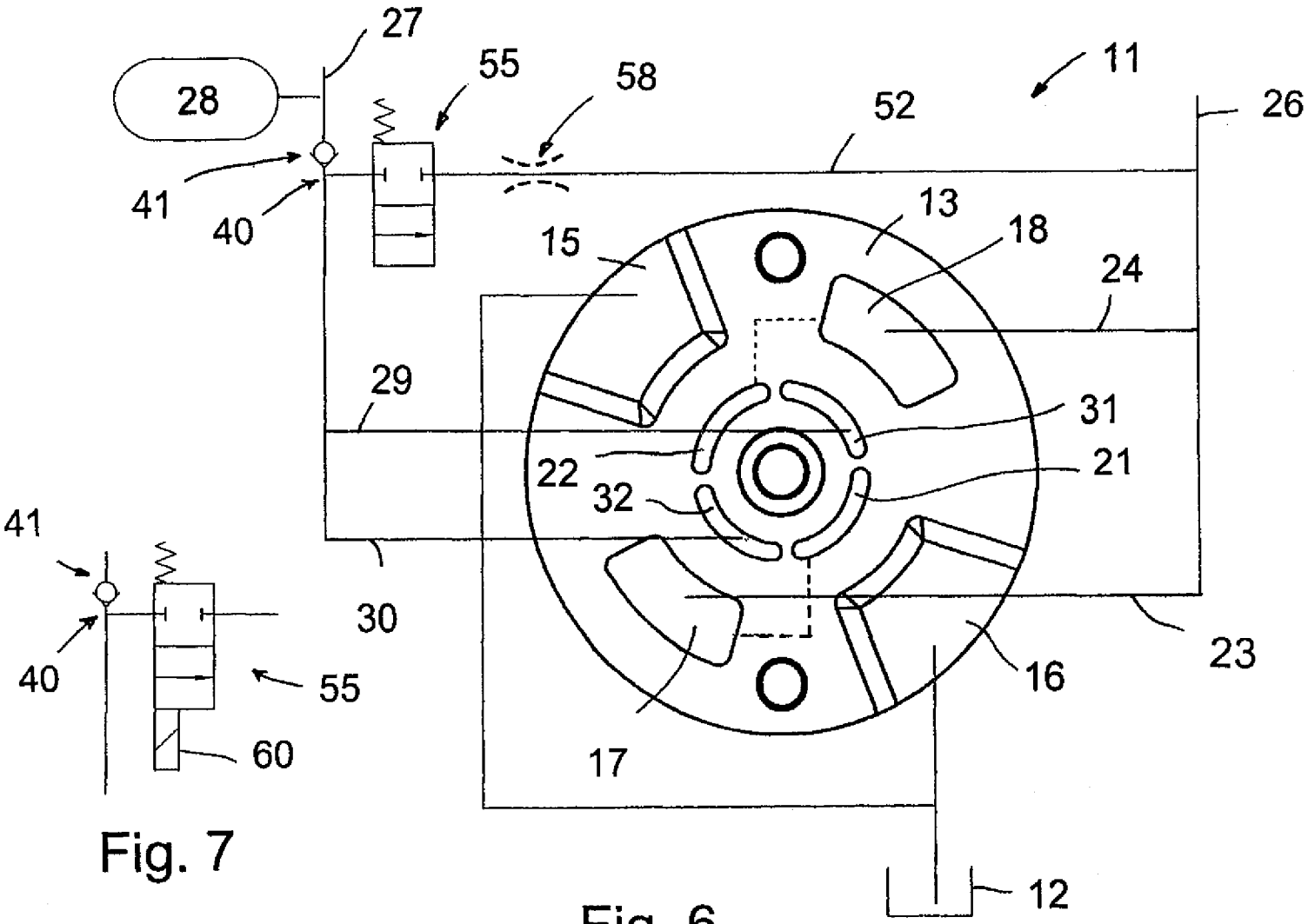
FIG. 6 is an example similar to that in FIG. 2 with a connection between one of the under vane areas and a consumer not associated therewith.
FIG. 7 is a variant of a switching valve from FIG. 6.

FIG. 6 shows the vane cell pump 11 in which the branch 40 is directly connectable to the pressure output of the over vane pump and first consumer 26, respectively, via a hydraulic line 52 or a hydraulic channel and with the intermediary of a switching valve device 55. This arrangement is advantageous in electrically driven vane cell pumps 11 which generally have a higher starting speed than pumps that are driven directly by a combustion engine.

According to another aspect of the invention, the operating pressure in the under vane slot portions 31, 32 of the under vane pressure area is always higher than the operating pressure in the under vane slot portions 21, 22 of the under vane suction area. In this way, it can be ensured that the vanes in the pressure areas 17, 18 and the dividing areas always contact the lift contour during operation. In order to achieve a sufficient difference in operating pressures required for pump operation, a throttle 48; 58, indicated in dashed lines, is arranged downstream of the respective switching valve device 45; 55 in the hydraulic lines 42; 52 of the embodiment examples shown in FIGS. 5 and 6. The throttle 48; 58 can also be integrated in the respective switching valve device 45; 55.

In FIG. 7, symbol 60 indicates that the switching valve device 55 from FIG. 6 can be actuated electrically or electromagnetically. By electric or electromagnetic actuation, the switching valve 55 is preferably switched out of its blocking position, shown, into its open position, not shown, whenever the pressure in the hydraulic accumulator 28 is above a minimum pressure. To this end, the pressure in the hydraulic accumulator 28 is acquired by a pressure sensor.

FIG. 8 shows that the switching valve 45 shown in FIG. 5 can also be actuated hydraulically as is indicated by a control pressure line 64 and symbol 65 at the switching valve device 45. The switching valve 55 shown in FIG. 6 can be actuated hydraulically just like the switching valve 45 shown in FIG. 8. When actuated hydraulically as is shown in FIG. 8, the pressure in the hydraulic accumulator 28 is used directly for sensing.

At a lower switching point at the hydraulic accumulator 28, the switching valve 45 is closed and the under vane pump delivers to the hydraulic accumulator 28 via the under vane slot portions 31, 32 of the under vane pressure area via non-return valve 41. At an upper switching point, the switching valve 45 is opened and the under vane pump delivers with the under vane slot portions 31, 32 of the under vane pressure area via the under vane slot portions 21, 22 of the under vane suction area and the pressure areas 17, 18 with the lower operating pressure of the over vane pump.

Figure 9:
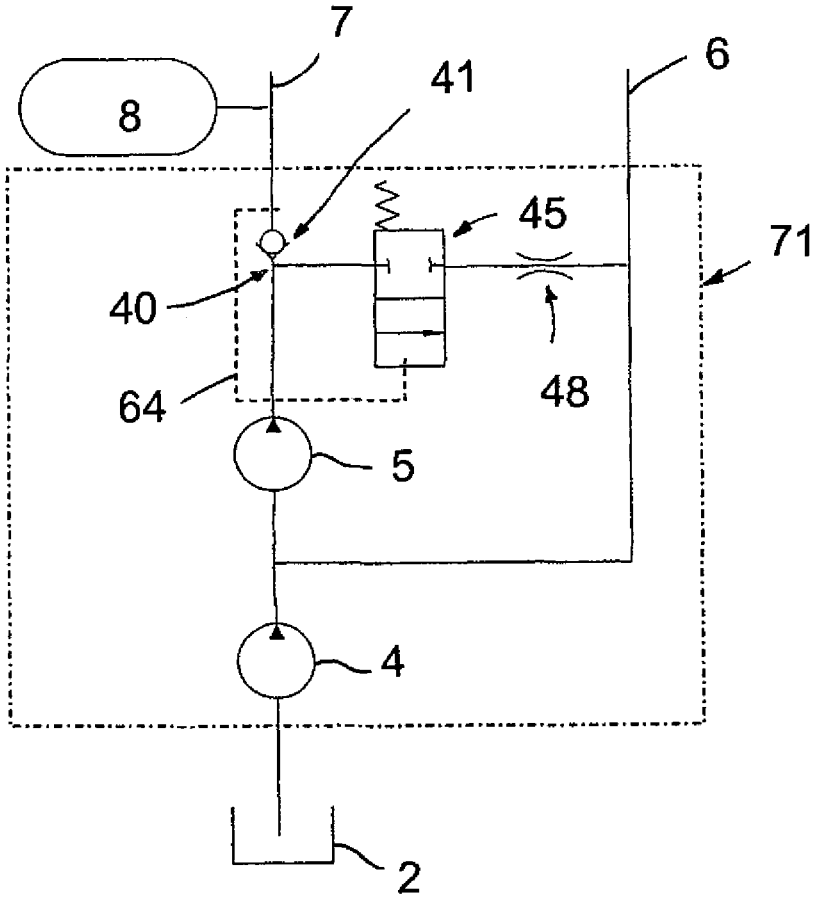
FIG. 9 is a view similar to that in FIG. 1 with valves integrated in the vane cell pump.

A vane cell pump 71 similar to that shown in FIG. 1 is illustrated in a highly simplified manner in FIG. 9. Since, in contrast to the over vane pump area 4, only relatively small volume flows are supplied to the second consumer 7 by the under vane pump area 5, the non-return valve 40 and the switching valve device 45 can both be constructed so as to be relatively small and can be integrated in the vane cell pump 71 in a simple manner. Further, the throttle 48 can be integrated in the vane cell pump 71, particularly in the switching valve 45. This results in a compact constructional unit which need only be connected to the tank 2 and the two consumers 6 and 7 by three connections.

Figure 10:
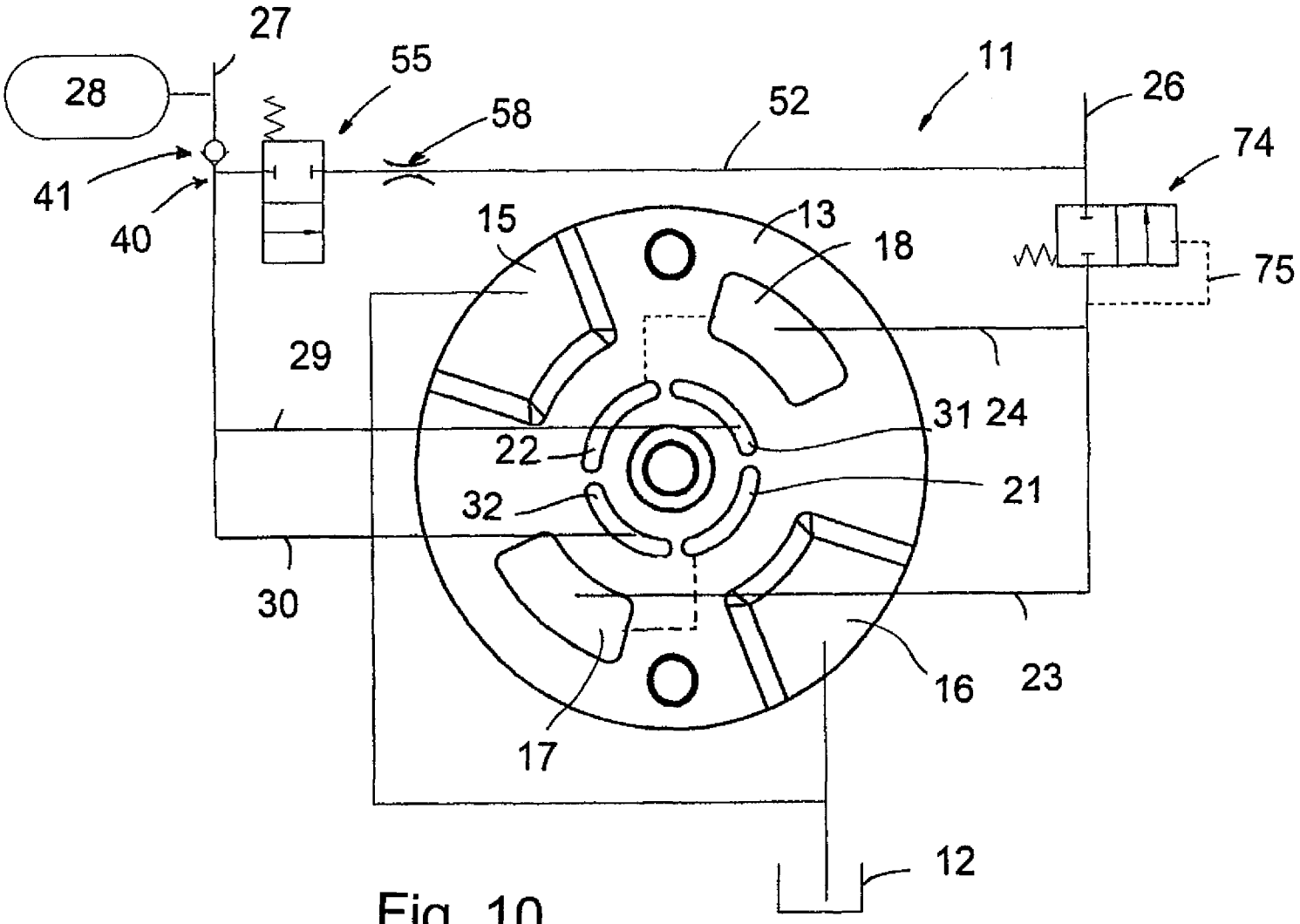
FIG. 10 is an example similar to that in FIG. 6 with an additional switching valve device.
Figure 11:
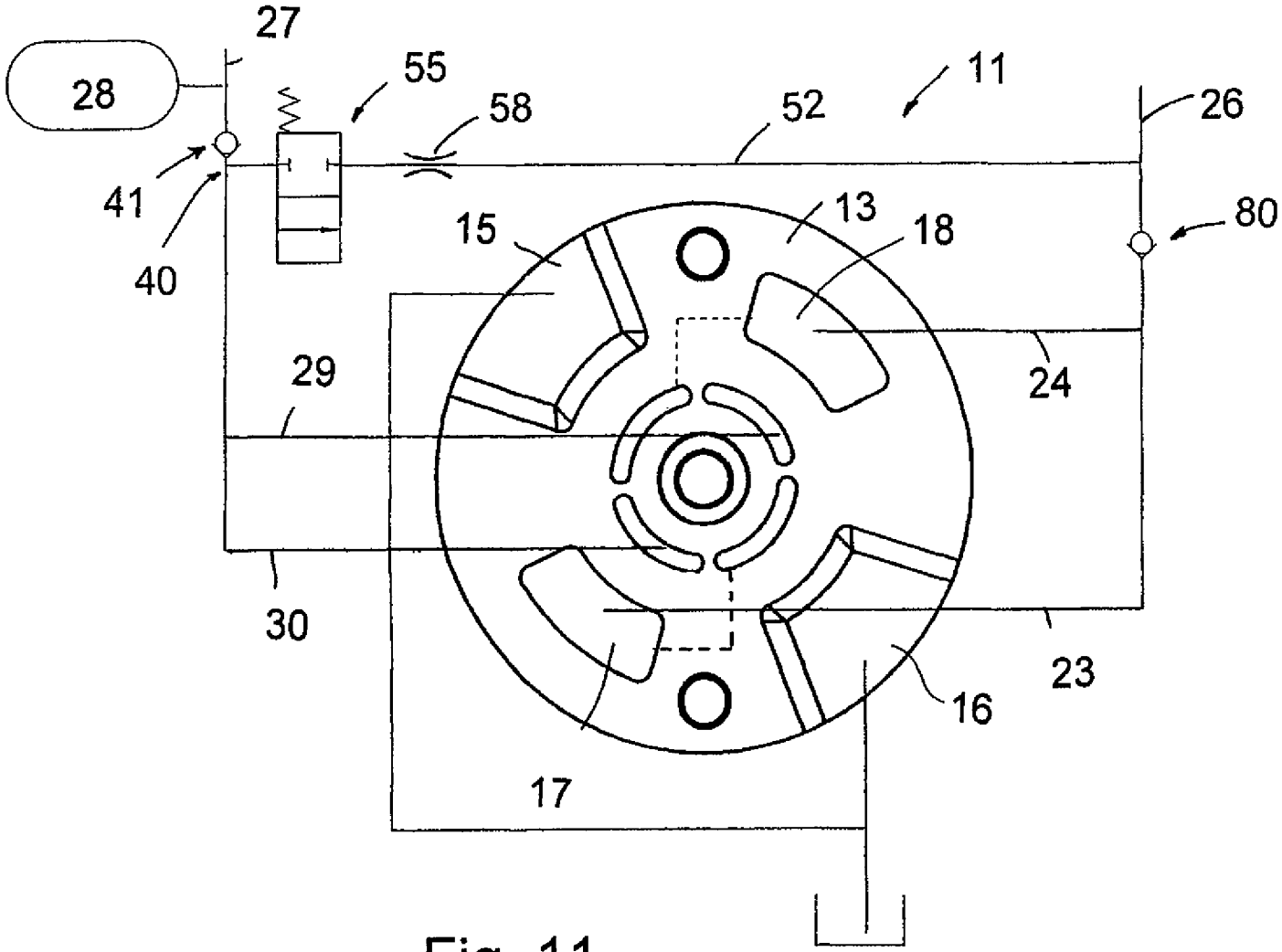
FIG. 11 is an example similar to that in FIG. 10 with a non-return valve.

FIGS. 10 and 11 show that the output of the over vane pump can be separated from the consumer 26 through a switching valve device 74 and a non-return valve 80, respectively. Accordingly, an unwanted backflow of hydraulic medium from the consumer 26 can be prevented. The switching valve 74 shown in FIG. 10 is constructed as a 2/2 directional control valve which is pre-loaded in its blocking position, shown, by means of a spring. During operation of the vane cell pump 11, the operating pressure of the over vane cell pump acting on the switching valve 74 via a control pressure line 75 ensures that the switching valve 74 opens and the connection between the vane cell pump 11 and the consumer 26 is released. The spring side of the switching valve 74 is connected to ambient pressure so that there are no throttle losses at the switching valve 74 for holding the switching valve 74 open.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A vane cell pump comprising:

an over vane pump associated with a first consumer; and an under vane pump comprising an under vane pressure area and an under vane suction area connected to the over vane pump, wherein the under vane pressure area is associated with a second consumer;

a figure 8 shaped seal configured to separate the under vane pressure area from the under vane suction area, the under vane suction area being arranged outside the figure 8 shaped seal and the under vane pressure area being arranged inside the figure 8 shaped seal , the area inside the figure 8 shaped seal is open providing a connection between portions of the under vane pressure area, wherein the subdivided under vane areas are acted upon by different pressures.

2. The vane cell pump according to claim 1, wherein the under vane suction area comprises at least one under vane slot portion associated with the first consumer via a pressure area of the over vane pump.

3. The vane cell pump according to claim 2, wherein the at least one under vane slot portion of the under vane suction area is arranged radially inwardly and overlapping in circumferential direction in relation to a suction area of the over vane pump.

4. The vane cell pump according to claim 3, wherein the under vane pressure area comprises at least one under vane slot portion associated with the second consumer.

5. The vane cell pump according to claim 4, wherein the at least one under vane slot portion of the under vane pressure area is arranged radially inwardly and overlapping in circumferential direction in relation to the pressure area of the over vane pump.

6. The vane cell pump according to claim 4, wherein the under vane suction area and the under vane pressure area each comprise two diametrically arranged under vane slot portions.

7. The vane cell pump according to claim 1, wherein the second consumer comprises a hydraulic accumulator.

8. The vane cell pump according to claim 1, further comprising a non-return valve arranged between the second consumer and its associated under vane pressure area.

9. The vane cell pump according to claim 1, wherein the under vane pressure area is connected to the under vane suction area by a switching valve device.

10. The vane cell pump according to claim 9, wherein the switching valve device is actuated either electromagnetically or hydraulically.

11. The vane cell pump according to claim 1, wherein the under vane pressure area is connected to the first consumer by a switching valve device.

12. The vane cell pump according to claim 11, wherein the switching valve device is actuated either electromagnetically or hydraulically.

13. The vane cell pump according to claim 1, wherein an additional valve device is connected between one of the under vane suction area and the pressure area of the over vane pump and the consumer associated therewith.

14. The vane cell pump according to claim 1, wherein an operating pressure is greater in the under vane pressure area than in the under vane suction area.

15. The vane cell pump according to claim 1, wherein a hydraulic resistance is connected between the under vane area and the first consumer.

16. The vane cell pump according to claim 1, wherein the over vane pump and the under vane pump are configured to supply fluid flow at least at one of different magnitude and pressure.

* * * * *